United States Patent [19]

Sylvester

[11] Patent Number: 4,947,604

[45] Date of Patent: Aug. 14, 1990

[54] SEALANT WITH UNIFORM SPACER PARTICLES

[76] Inventor: Michael S. Sylvester, W. Hill Dr., Gates Mills, Ohio 44040

[21] Appl. No.: 185,482

[22] Filed: Apr. 25, 1988

[51] Int. Cl.[5] ..... E04B 1/62

[52] U.S. Cl. ..... 52/398; 156/276

[58] Field of Search ..... 156/276; 52/398

[56] References Cited

U.S. PATENT DOCUMENTS 2,872,365 2/1959 de Bruyne ..... 156/276

4,078,855 3/1978 Fujita et al. ..... 350/356

FOREIGN PATENT DOCUMENTS 30259 8/1974 Japan ..... 156/276

*Primary Examiner*—Carl D. Friedman

*Assistant Examiner*—Michele A. Van Patten

*Attorney, Agent, or Firm*—Pearne, Gordon, McCoy & Granger

[57] ABSTRACT

A rubbery sealant for between the edge faces of insulating glass units and the sash containing a small percentage by weight of spacer particles of uniform diameter and a process of using the same in the manufacture of insulating glass windows and doors.

4 Claims, 3 Drawing Sheets

SEALANT WITH UNIFORM SPACER PARTICLES

BACKGROUND OF THE INVENTION

This invention relates to a sealant for prefabricated insulating glass windows and doors.

Prefabricated insulating glass windows and doors generally comprise a rectangular sash with a rabbet adapted to receive the edges of an insulating glass unit and stops nailed to the sash to keep the insulating glass in place. Preferably the insulating glass is automatically bedded and glazed in place with a sealant between the sash rabbet and the edge faces of the bottom sheet of glass of the insulating glass unit and with a sealant between the edge faces of the top sheet of glass of the insulating glass unit and the stops.

The sealant between the edge faces of the top glass sheet and the stop usually comprises a silicone rubber. The sealant between the edge faces of the bottom glass sheet has been a similar silicone rubber or a foam strip.

When a silicone rubber or similar sealant is used for the seal between the edge face of the bottom sheet of glass and the sash rabbet, and the sealant layer is too thin, there is a tendency for the seal to be broken and for the bottom sheet of glass to crack at points of stress concentration which develop when the glass sheets work in response to changes in atmospheric pressure and temperature.

The sealant layer can become too thin when the insulating glass unit is set on the sash rabbet and the weight of the unit squeezes out the sealant.

In an effort to avoid this problem, some manufacturers use strips of foam as the sealant between the sash rabbet and the edge faces of the bottom sheet of glass. While the strips of foam avoid the cracking problem as the glass sheets work, they have another problem, which is that the strips tend to shrink longitudinally and leak cold air at the corners and develop pockets of moisture. Additionally, the foam strips have to be applied by hand. Silicone rubber sealant can be applied automatically.

There generally is not a stress concentration problem at the seal between the edge faces of the top sheet of glass and the stops because the stops are nailed in place and give or work enough to avoid stress concentration points. Also, there is less tendency for the layer of silicone rubber sealant to become too thin because when the stops are applied, they do not squeeze out the sealant. Even with sash units which are made of extruded aluminum sections or the like, the stops for the top sheet of glass are more forgiving and there is less tendency for areas of stress concentration to develop.

The problem, therefore, is with the seal between the edge faces of the bottom sheet of glass of the insulating glass unit and the rabbet of the sash.

SUMMARY OF THE INVENTION

The object of the present invention is to provide a permanent seal between the glass rabbet of the sash and the edge faces of the bottom sheet of the insulating glass unit and to relieve and/or prevent the build-up of stress concentration points between the edge faces of the bottom sheet of the insulating glass unit.

In accordance with this invention, relatively small amounts of spacer particles are dispersed in the sealant. The particles are of substantially uniform diameter and range in diameter between about 0.020 to about 0.125 inch. The particles space the edge faces of the bottom sheet of the insulating glass unit from the glass rabbet of the sash so as to avoid a squeeze-out of the sealant and so as to avoid any points of stress concentration. If a point of stress concentration does develop, the particles give or the low compressive strength of the particles causes the particles to crumble and relieve that point of stress concentration.

DESCRIPTION OF THE PREFERRED EMBODIMENT

Figure 1:
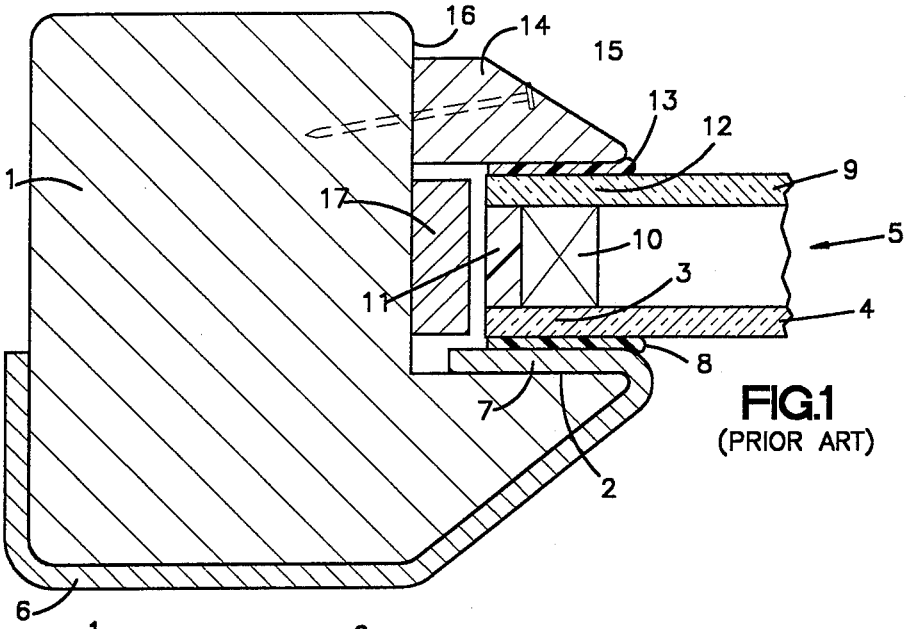
FIG.1 (PRIOR ART)
FIG. 1 is a cross section of a portion of a prior art insulating glass window in a horizontal position as it is being assembled. The sealants for the bottom and top sheets of glass are prior art silicone sealants.

The windows and doors with which we are here concerned comprises a sash 1 provided with a glass rabbet 2 which is adapted to receive and support the edge face 3 of the bottom sheet of glass 4 of the insulating glass unit 5. A protective molding strip 6 may or may not rest on the glass rabbet 2 and be disposed against the surfaces of the sash 1, as shown. The molding strip 6 fits over the glass rabbet 2 of the sash 1. A portion 7 of the molding strip on the glass rabbet 2 of the sash, called the "sticking," receives the sealant 8.

The rest of the insulating glass unit 5 comprises a top sheet 9, a spacer 10, and an edge seal 11.

The edge face 12 of the top sheet 9 is provided with sealant 13. A stop 14 is disposed above the sealant 13 and set in place with nails 15.

Attached to the side 16 of the sash 1, at right angles to the glass rabbet 3, is a spacer block 17.

The windows and doors are assembled in the horizontal position and then stacked vertically for storage and packing. The sealant may take up to at least about twelve hours to cure up. If the insulating glass unit 5 does shift slightly when it is stacked in the vertical position, the spacer block 17 minimizes any such shifting.

The insulating glass unit 5 is always bedded and glazed onto a sticking which supports the bottom edge faces 3 of the bottom sheet of glass 4. The top sheet of glass 9 is always held with stops 14. Thus, in the assembly process, the full weight of the insulating glass unit must be supported by the sticking which, as noted, can be the glass rabbet 3 of the sash 1 or the shelf portion 7 of the molding strip 6 and there has to be some form of sealant between the sticking and the edge faces 3 of the bottom sheet of glass 4.

The stop 14 abuts the side 16 of the sash 1. Nails 15 go through the stop 14 and into the side face 16 of the sash 1, as shown. The sash 1 and stop 14 as shown are milled wooden members. The sash can be made of extruded aluminum, vinyl, or other materials, as is well known in the art. The sash 1 is usually a rigid, unforgiving member. The stop 14 on the other hand, is forgiving in that it can yield slightly should forces build up between the edges 12 of top glass sheet 9 and the stop 14. The stop 14 likewise can be made of extruded aluminum or other materials, as is well known in the art.

The windows or doors are usually mounted so that the protective molding strip 6 is on the outside, exposed to the weather, and the stops 14 are on the inside.

Figure 2:
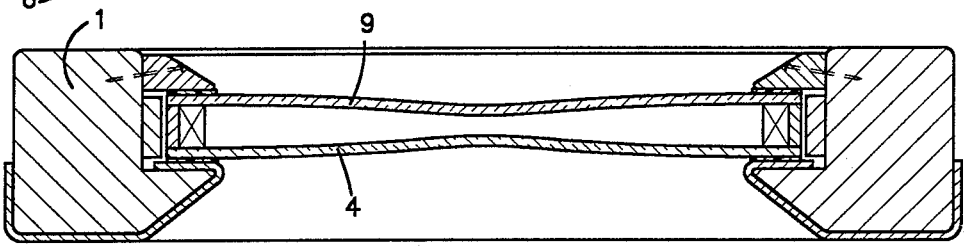
FIG.2 (PRIOR ART)
FIG. 2 is a cross section of the prior art window of FIG. 1, showing how the top and bottom sheets of glass come together and work with a change of atmospheric pressure.
Figure 3:
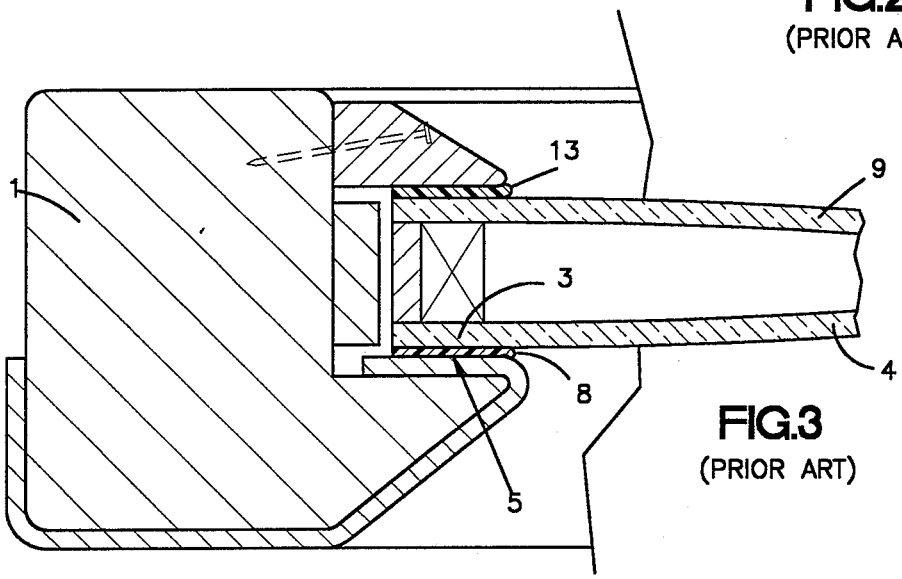
FIG.3 (PRIOR ART)
FIG. 3 is a cross section of a portion of the prior art window of FIG. 2 above, showing where the points of stress concentration develop.

FIGS. 2 and 3 are intended to illustrate what happens when the top and bottom sheets of glass of the insulating glass unit work or come together as a result of a change in atmospheric pressure or temperatures, or both. The showing is exaggerated for illustrative purposes. As shown in FIG. 2 in particular, the top and bottom sheets of glass of the insulating glass unit are not parallel to each other, but are closer together in the middle than at the ends. This causes forces to build up at the edge faces 3 and 12 of the bottom and top sheets of glass.

Because the stop 14 is forgiving and can yield, and because the thickness of the layer of sealant 11 between the stop and the edge faces 12 of the top sheet of glass 9 is generally uniform and sufficient, these forces do not present a problem for the edge face 12 of the top sheet 9.

With respect to the edge face 3 of the bottom sheet 4, however, when the insulating glass unit is set on the sticking 7 of the molding strip 6, before the rubbery silicone sealant 8 has cured or set up, the weight of the unit 5 can squeeze out some of the sealant and create areas which have sealant layers less than thirty thousandths of an inch thick. The layer of sealant 8 in FIG. 3 is shown in a thinned-out condition. The thickness of the sealant should be at least about 0.030 of an inch. The force on the edge face 3 of the bottom sheet 4 which is developed when the bottom sheet 4 bends inwardly, as shown in FIG. 2, causes a stress point indicated by the arrow S. The bottom sheet of glass 4 may thus crack or break as a result of this stress point when the sealant layer is too thin.

Figure 4:
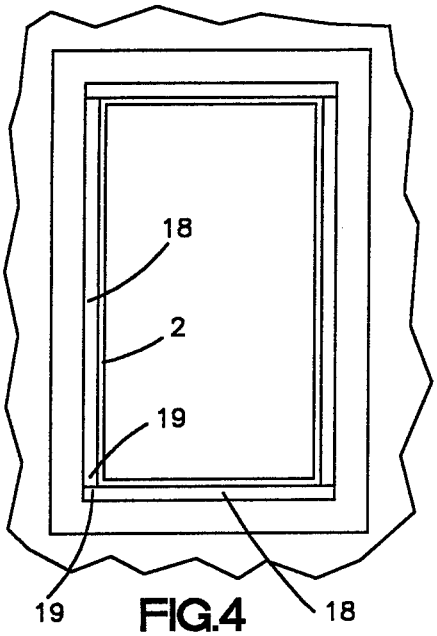
FIG.4 (PRIOR ART)
FIG. 4 is a plan view of a prior art window in which the sealant for the bottom sheet of insulating glass is a strip of foam.
Figure 5:
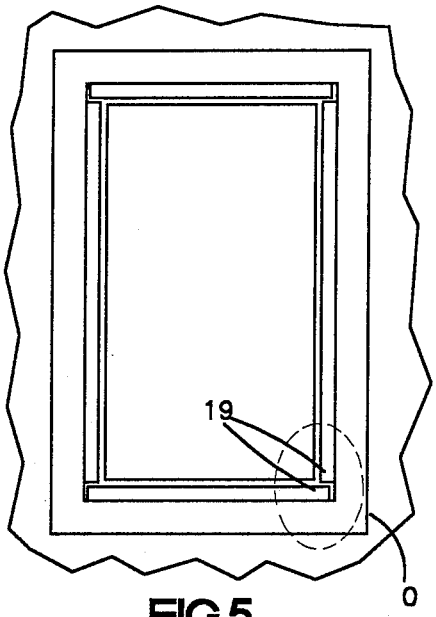
FIG.5 (PRIOR ART)
FIG. 5 is a plan view similar to that of FIG. 4, showing how the foam strips shrink and allow for leakage at the corners.
Figure 6:
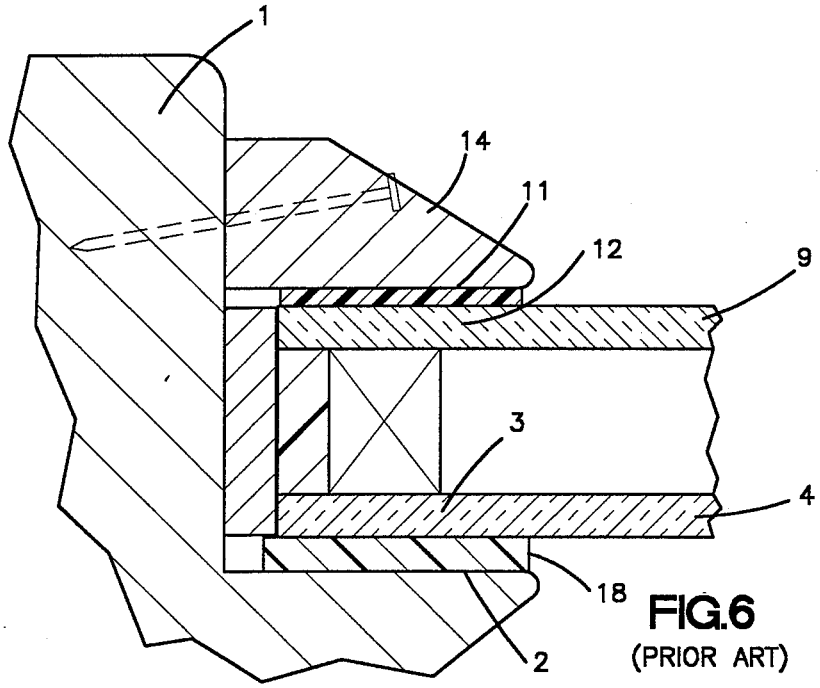
FIG.6 (PRIOR ART)
FIG. 6 is an enlarged cross-sectional view of a portion of the window of FIG. 4.

In order to avoid the problem described above, some manufacturers use strips of foam 18 which are disposed by hand on the glass rabbet 2, as shown in FIGS. 4. 5, and 6. The ends 19 of the strips of foam 18 are supposed to abut each other. If the lengths of the strips of foam are not cut to exact lengths, or if the foam strips shrink, then an opening develops where the ends should abut, as shown in FIG. 5 by the designation 0 in the circle. This is undesirable because it lets in cold air and moisture. This method of dealing with the problem is also undesirable because the foam strips have to be assembled or laid up by hand.

The silicone seals 3 and 12 can be applied automatically by an automatic bedding and glazing system, such as sold by Aztech Corporation, of Somerville, N.J.

Figure 7:
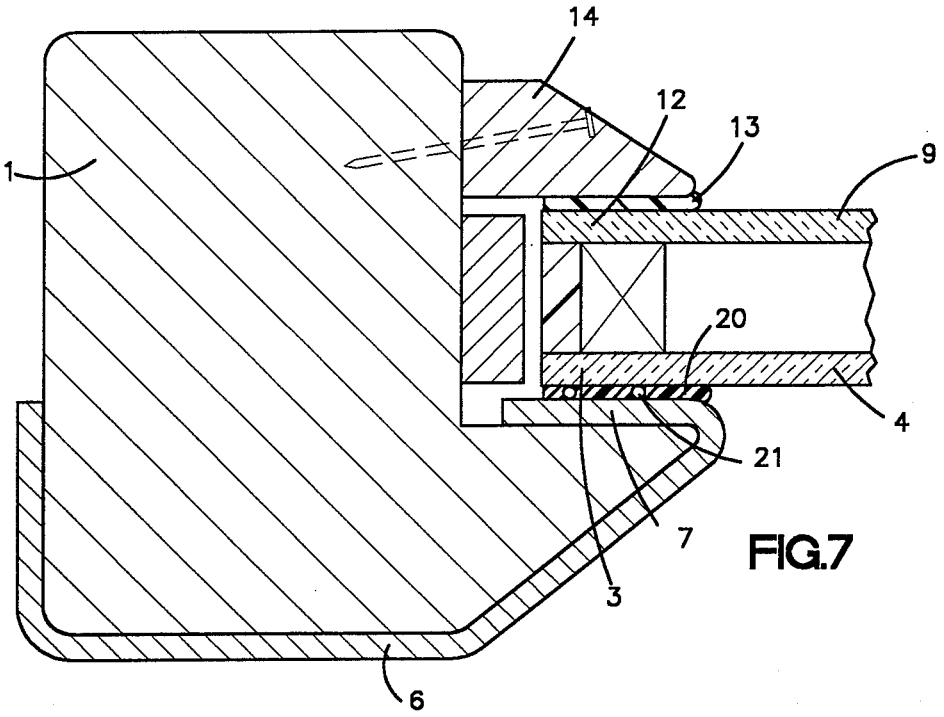
FIG. 7 is an enlarged cross-sectional view of a portion of a window incorporating a sealant of the present invention.

In accordance with the present invention, I add small amounts of spacer particles 21 of substantially uniform diameter to the sealant 20 (FIGS. 7 and 8) so that the weight of the insulating glass unit does not squeeze out the sealant and so that if points or areas of stress concentration do develop between the spacer particles 21 and the bottom sheet of glass 4 of the insulating glass units, the particles will crumble or otherwise give. This is shown in FIG. 7. The sealant layer 20 contains the spacer particles 21.

Figure 8:
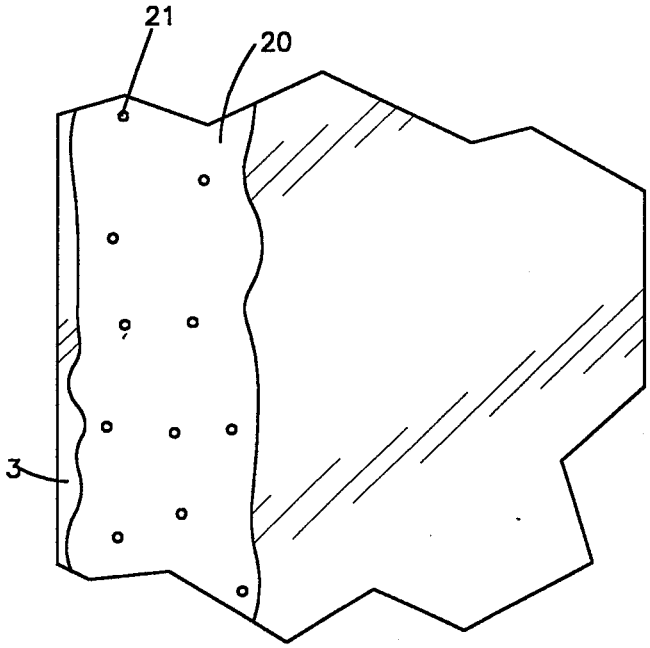
FIG. 8 is a plan view of a length of sealant of the present invention disposed on the glass rabbet of the sash with the bottom sheet of glass of the insulating glass unit resting on it and with portions of the glass broken away, showing the distribution of spacer particles in the sealant supporting the glass sheet.

FIG. 8 is a plan view of a layer of the sealant 20 of my invention on the edge 3 of the bottom sheet of glass 4. Shown distributed in the sealant 20 are the spacer particles 21.

The sealant 20 is preferably a silicone rubber. One sealant is the silicone glazing sealant sold by Dow Corning Corp. of Midland, Mich. under their registered trademark SILICONE 795. Silicone 795 sealant is a neutral, methyl alcohol cure silicone used as a glazing compound or sealant for architectural applications. It cures at room temperature. When applied, it begins to cure in a few hours, but may take one week or more to achieve a full cure.

The sealant should be rubbery, and should adhere to glass, wood, vinyl, and metal. Other sealants well known in the art are various acrylic polymers, urethane polymers, and sulfide polymers. The sealant may be a latex sealant, as is well known in the art. The sealant should be able to be dispersed with automatic handling equipment.

The spacer particles should be of uniform size within a range of about 0.020 inch to about 0.125 inch in diameter, and should be compressible or friable so as to give or crumble under pressure to avoid areas of stress concentration. The spacer particles must be thoroughly mixed into the sealant. The viscosity of the sealant keeps them in suspension until the sealant is dispersed. The specific gravity of the spacer particles should be matched to the specific gravity of the sealant so that the particles stay in suspension.

The spacer particles should be reasonably uniform in size. I prefer to put them through sieves in order to control their size ranges. The particles should not vary in diameter by more than about 0.020 inch, and preferably by not more than about 0.015 inch. The smaller diameter particles are for lighter units, and the larger diameter particles are for heavier units. For lighter units, spacer particles with diameters of 0.038 inch plus or minus 0.010 are satisfactory. For heavier units, diameters of 0.055 inch plus or minus 0.010 are satisfactory. The range for spacer particles is about 0.020 up to 0.125 inch in diameter.

The preferred amount of spacer particles is about 3 grams of particles per 10 ounces of silicone sealant, or about 1% by weight. This provides about one spacer particle per inch of glass, as I have attempted to illustrate in FIG. 8.

As the size and weight of the insulating glass unit increase, for instance, in doors or large picture windows, it may be necessary to increase the amount and/or size of the spacer particles. From about ½% to about 2%, spacer particles by weight can be added to the sealant. When applied to a glass rabbet of the sash or sticking, there should be at least one spacer particle per inch of sealant. The amount of the spacer particles in the sealant, however, should be just enough to prevent the weight of the insulating glass unit from squeezing out the sealant. Spacer particles in excess of what is required for their specific purpose can cause complications, such as settling out of the sealant in storage, clogging of the automatic dispensing equipment, and interference with the proper curing of the sealant. The spacer particles are preferably added at the end of the manufacturing process for the sealant.

Preferred spacer particles are 4A molecular sieve zeolite silica gel beads sold by Zeochem of Louisville, Ky. These beads come in two size ranges, 0.5–1.0 mm and 1.0–2.0 mm. The typical average crush per bead for the 0.5–1.0 mm beads is 1.0 pound. The typical average crush per bead for the 1.0–2.0 mm beads is 4.0 pounds. I can also use synthetic amorphous silica gel beads, which can be obtained from Zeolite, and have a typical average crush per bead of at least 12 pounds.

I use the small size for windows and the larger size for doors. I put the small size through a 0.029 inch mesh screen and then a 0.045 inch mesh screen. I put the large size through the 0.045 inch Other particles which may be used are some of the natural or artificial zeolites, activated alumina, and anhydrous calcium sulfate particles. The particles should be of substantially uniform size within the ranges given above. The nature of the particles has to be such that they can be sorted out to pass through a sieve and be segregated into uniform diameter. The hardness of the particles should preferably be less than 4 on Moh's hardness scale.

The above particles should have a typical average crush of from about 1 pound up to about 10 to 15 pounds or more up to 20pounds, depending upon the size of the insulating glass unit.

As spacer particles, I believe that I can also use polypropylene copolymers manufactured by the SPHEROL process of Himont Incorporated, and perhaps ethylene vinyl acetate particles and particles of other resins. Since the polymeric particles will tend to give and compress without fracturing they should be larger in diameter than 4A silica gel particles for the same application and this factor must be taken into consideration when determining particle sizes. The resin particles may be from 0.030 up to about 0.150 inch in diameter.

A further advantage of this invention is that the presence of the spacer particles controls the extrusion of sealant from between the edge face of the glass sheet 3 and the glass rabbet of the sash or sticking upon which it rests so that hand-trimming of the sealant after its application is not required. In other words, the sealant can be dispersed automatically and hand clean-up is avoided, thus saving a substantial amount of labor.

The sealant of this invention has particular application to the automatic bedding and glazing of insulating glass units. It can, of course, be used with single glass units. There may be other applications for which the sealant will serve the same purposes.

Other variations and modifications of my invention will be apparent to those skilled in the art. The patent is not to be limited in scope and effect in any way that is not consistent with the extent to which the art has been advanced by the invention.

What is claimed is:

1. The combination of an insulating glass unit, sash, and stops in which the sealant between the edge faces of one sheet of the insulating glass unit and the sticking of the sash contains from ½% to 2% by weight of spacer particles which are of substantially uniform diameter and are from 0.020 to 0.125 inch in diameter and are capable of crushing at points of stress concentration before the one sheet of glass of the insulating glass unit with which the sealant is in contact will break.

2. The combination of claim 1 in which the sealant is a silicone rubber and the spacer particles are zeolite silica with a typical average crush of from 1 to 15 pounds.

3. The combination of claim 1 in which the sealant is a silicone rubber and the spacer particles are synthetic amorphous silica gel with a typical average crush of from 1 to 15 pounds.

4. A process of bedding and glazing an insulating glass unit on the sticking of a sash comprising the steps of:

(1) disposing a sash in a horizontal plane with the glass rabbet facing upwards;

(2) disposing a bead of uncured sealant on the surface of the sticking, said sealant containing from ½% to 2% by weight of crushable spacer particles of substantially uniform diameter and of from 0.020 to 0.125 inch in diameter;

(3) aligning the insulating glass unit up with the sash opening;

(4) lowering the insulating glass unit in a horizontal plane down onto the sash so that the bottom edge portions of the bottom sheet of the insulating glass unit rest upon the sealant disposed on the sticking of the sash, whereby the weight of the insulating glass unit is accommodated by the spacer particles and the uncured sealant is not squeezed out from between the sticking of the sash and the edge portions of the bottom sheet of the insulating glass unit;

(5) removing the sash and insulating glass unit for storage and packing and;

(6) allowing the sealant to cure, whereby before points of stress concentration can build up between the bottom sheet of glass of the insulating glass unit and the sticking of the sash which are enough to break the bottom sheet of glass, the spacer particles will crush.

* * * * *